United States Patent [19]

Geiger et al.

[11] 4,238,205

[45] Dec. 9, 1980

[54] MAKING OF PILGER ROLL

[75] Inventors: Otto Geiger, Ratingen; Karl-Ernst Genter, Düsseldorf-Benrath, both of Fed. Rep. of Germany

[73] Assignee: Mannesmann Aktiengesellschaft, Dusseldorf, Fed. Rep. of Germany

[21] Appl. No.: 897,139

[22] Filed: Apr. 17, 1978

[30] Foreign Application Priority Data

Apr. 22, 1977 [DE] Fed. Rep. of Germany ..... 2718603

[51] Int. Cl.[3] ..... B24B 19/08

[52] U.S. Cl. ..... 51/33 W; 51/49

[58] Field of Search ..... 51/33 W, 35, 49, 50 R, 51/289 R; 90/17; 409/201

[56] References Cited

U.S. PATENT DOCUMENTS

| | | | |
|---|---|---|---|
| 1,325,789 | 12/1919 | Johnsson | 51/33 W |
| 2,392,667 | 1/1946 | Hawkinson | 51/33 W |
| 2,766,559 | 10/1956 | Pixley | 51/33 W |
| 3,815,288 | 6/1974 | Wilson | 51/35 |

FOREIGN PATENT DOCUMENTS

| | | | |
|---|---|---|---|
| 1179438 | 8/1964 | Fed. Rep. of Germany | 51/50 R |
| 265748 | 6/1970 | U.S.S.R. | 51/289 R |
| 479613 | 12/1975 | U.S.S.R. | 51/49 |

*Primary Examiner*—Gary L. Smith

*Attorney, Agent, or Firm*—Smyth, Pavitt, Siegemund, Jones & Martella

[57] ABSTRACT

The grinding wheel and roll are particularly positioned to each other on the basis of parameters representing the local slope changes of the roll groove and its deviation from a semi-toroidal groove. The grinding wheel can be moved in two orthogonal directions, one being transversely to its normal orientation, but needs tilting therefrom while the roll is moved transversely to both directions. Digital control moves the parts into the desired positions.

6 Claims, 9 Drawing Figures

MAKING OF PILGER ROLL

BACKGROUND OF THE INVENTION

The present invention relates to contouring the groove of and in a pilger type roll particularly for a cold pilger rolling mill; and more particularly, to cutting and grinding the peripheral and cross-sectional contours of the groove by means of a grinding wheel or disk whose position and orientation is varied as grinding progresses.

The German Pat. No. 1,179,438 discloses equipment for grinding and milling a contour groove in the periphery of a roll using a rotating grinding disk which is tuned on a circle whose radius corresponds to the cross-sectional radius of the groove to be grinded, the axis of turning or pivoting extends transversely to the axis of rotation of the disk. In other words, the disk's periphery is moved over a circle in a plane defined by the axes of the disk and the roll. The points of contact between disk and roll is, however, not necessarily located in that same plane so that the resulting contour of the groove is somewhat distorted. The distortion depends on the diameter of the grinding wheel and the degree of wear thereof. In other words, a groove ground with a new wheel differs from the groove ground with a worn wheel, other conditions being the same. Of course, one could modify the control of the wheel's motion to compensate the progressing wear and resulting contour changes. However, it turns out that this correction is possible only as to the outer edges and the bottom of the groove, but not for the in-between areas. The control is provided, for example, by means of cams as shown, e.g. in German printed patent application No. 1,813,281.

In accordance with recent research results, it is necessary to define and to establish the effective groove of a pilger roll and its surface contour to a very high degree of accuracy in order to avoid fractures in and of the rolling mandrel or even of the rolls themselves. It has to be stated that we do not believe that any of the known methods for making the effective groove and its contour in a pilger roll are capable of accurately duplicating particular predetermined contours, having been, e.g. calculated in accordance with particular requirements and conditions for rolling particular hollows. Rather, deviations seem to be inevitable being the larger the larger the diameter reduction and inclination angle of the groove. The main reason seems to be that groove contour varies peripherally, i.e. azimuthally, which, in turn, makes it inevitable that the point of engagement between roll and grinding disk is outside of the plane defined by roll and disk axes. The distance of this point of engagement from that plane varies along the periphery and the advance angle of the groove.

DESCRIPTION OF THE INVENTION

It is an object of the present invention to avoid the disadvantages above and to provide a new and improved method for making the groove in a pilger roll for cold pilger rolling so that (a) any geometrically predetermined contour can, in fact, be ground accurately;

(b) errors in the contour determining system which previously could be compensated only as to descrete points should be susceptible to compensation over the entire surface of the groove;

(c) the degree of wear of the grinding disk should not interfere with the correction and compensation of the afore-mentioned errors.

In accordance with the invention, it was discovered that the roll and the grinding wheel grinding a peripheral groove for pilger rolling, engage in a work point in a particular orientation amounting to pivotal or angular displacement of the roll relative to a plane between the grinding wheel axis and the point of engagement at an angle which corresponds to the inclination change of the groove in azimuthal-raidal direction, moreover, the grinding wheel is to be tilted out of a plane transversely to the roll axis by an angle that corresponds to a change in the groove's contour inclination in axial direction. Orienting wheel and roll in that manner solves the problems outlined in the object statement.

In furtherance of the invention, equipment is suggested to carry out the method and to particularly establish each requisite work point of engagement between the peripheral groove of the roll and the grinding disk or wheel. Accordingly, the wheel is held for rotation on a cross slide arrangement for displacement in planes parallel to each other and to the axis of the roll. The roll is held on a spindle which is moved transversely to the planes and the axis of the roll. This latter displacement is used particularly to establish the effective pivotal displacement of the roll relative to the work point. The grinding disk is separately tilted. The various drives are controlled digitally on the basis of position data which describes the entire grinding process and defines the requisite work points of engagement to obtain the complete contour of a peripheral groove in a roll for pilger rolling. As the process is a dynamic one, carried out as the roll is rotated, a work point displacement compensation may be superimposed.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawing, FIGS. 1, 2 and 3 show a bed or foundation 1 carrying and supporting a stand or frame 22 as well as a cross slide for movement in the x and y directions. The cross slide includes a carriage 2 which is mounted on roller bearings 3 (FIG. 3). Carriage or slide 2 is moved and displaced by means of a non-contact controlled drive 5 via a ball roller spindle 4.

Figure 1:
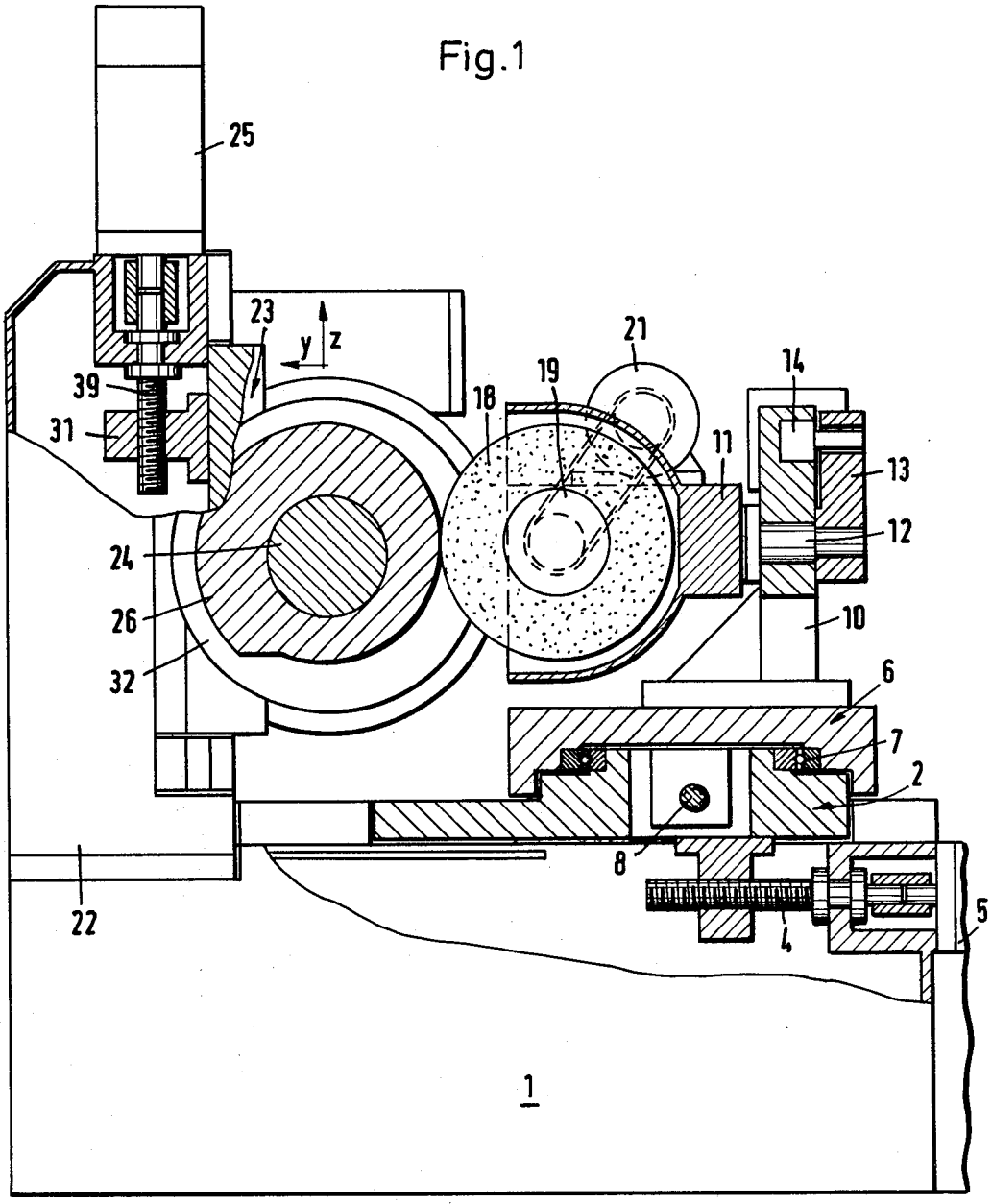
FIG. 1 is a section view of equipment for grinding the groove in a pilger roll whose axis is the direction x, transversely to the plane of the drawing.
Figure 2:
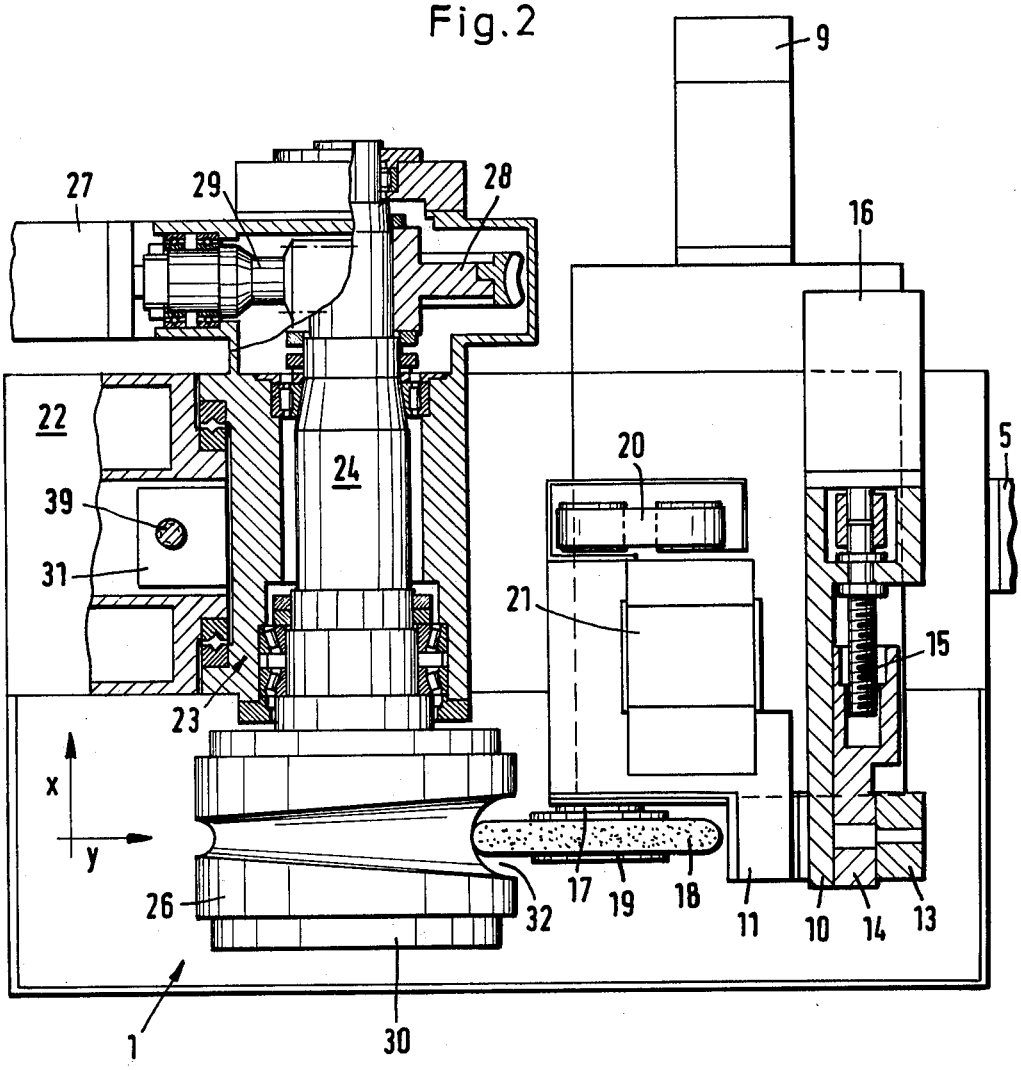
FIG. 2 is a top view of the equipment shown in FIG. 1, as seen in the direction opposite z.

Carriage 2, in turn, supports a grinding tool holder, carriage 6, by means of roller bearings 7. Carriage or slide 6 is driven by another ball roller spindle 8 and another non-contact controlled, x-drive 9. A bearing block 10 is mounted on carriage 6 and a tool holder 11 is mounted on the block 10 in a manner permitting pivoting about a pin 12.

Tool holder 11 is pivoted by means of a lever 13 which engages a slide arm 14, and that arm is shifted by means of another ball roll spindle 15, which, in turn, is driven by another non-contact controlled pivot or tilt drive 16. A tool, i.e. grinding spindle 17, is mounted in tool holder 11 in such a manner that the center of the profile of a grinding wheel or disk 18 is situated on or coincides with the center of pin 12. Grinding wheel 18 is connected to axle 17 by means of a carrier 19 and is driven by a motor 21 via a belt drive 20. The tilt arrangement 12, 13, 14, 15 and 16 tilts the grinding wheel 18 about an axis transverse to the axis of the wheel 18. The wheel 18 has a semi-toroidal periphery.

The parts as described thus far permit the grinding disk 18 to pivot about an axis parallel to the y-direction, while the disk as a whole can be moved and positioned in the x and y directions, e.g. for position selection of the work point of grinding.

A roller carriage 23 runs on rolls in the stand 22. These rolls are oriented to permit movement of carriage 23 in the z direction. The carriage is driven via a further spindle 39 by a non-contact controlled drive 25. Carriage 23 is provided with a follower 31 for the spindle 39, and additionally supports a working spindle 24. A roll carrier and support 25 is secured to spindle 24 and carries a pilger roll 26 as the work of this machine. Spindle 24 is driven via a gear 28, a worm 29, and a non-contact controlled drive 27. This drive connection permits slow rotation of the roll 26 when worked upon.

Figure 3:
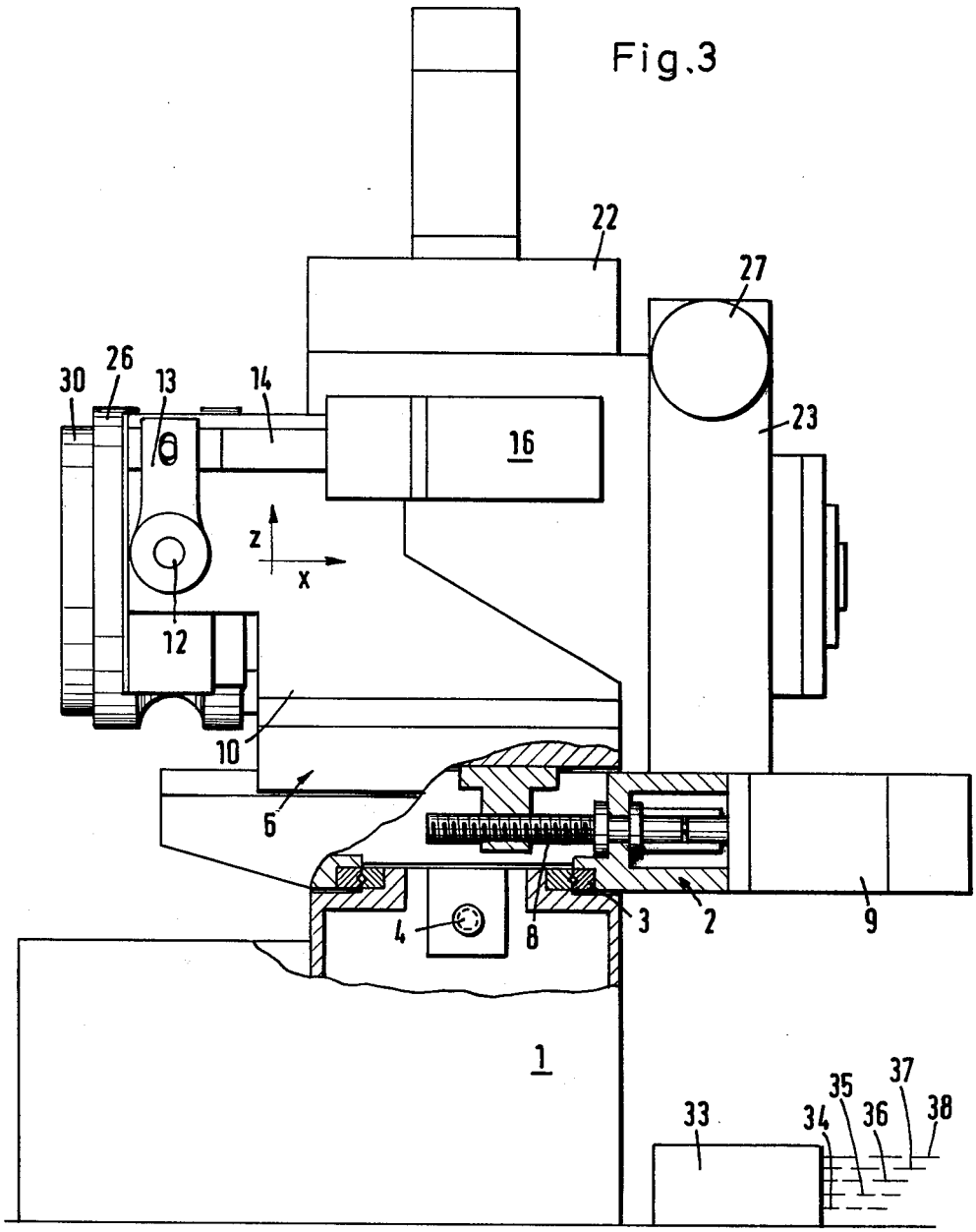
FIG. 3 is a side view of the equipment as seen in the direction opposite y.

FIG. 3 shows also a controller, e.g. digital controller 33, and control lines 24 to 38 run to the several drives such as y-drive 5, x-drive 9, pivot drive 16, shift drive 25, and drive 27 for rotating the work. As will be explained more fully below, the controller 33 is or may include a computer, e.g. a microprocessor which receives or stores position data and control data to move the carriages 2 and 6 in the x/y coordinate plane and system and to move and to position the carriage 23 in the requisite z position to obtain engagement of grinding disk 16 and work 26 for purposes of sequentially grinding the roll groove 32 as previously calculated. The grinding process is further modified by tilt data for the grinding disk (drive 16) and, in addition, work roll 26 is rotated particularly commensurate with azimuthal progress of the grinding process.

The machine as depicted could be supplemented for grinding two rolls at the same time. Work spindle 24 has to be modified in that case to carry two rolls, one on each side, and carriage 6 would be constructed to accommodate two wheels or disks 18.

Upon grinding the desired contour of groove 32 in roll 26, one grinds preferably along the periphery of the roll as the latter turns. After one full turn of the roll 26, disk 18 is shifted relative to the pilger roll axis, generally in direction x to a more or less parallel grinding track etc. The operative periphery of the grinding wheel is semi-toroidal. Accordingly, the intersection of that surface with, e.g. an x-y plane, is a semi-circle, provided the wheel is not tilted. Upon tilting that curve of intersection is, at least at a high degree of approximation, an ellipse. The work engages that ellipse in the grinding point. The angle of inclination of the ellipse in that point must be equal to the angle of inclination $\gamma_k$ (gamma-k) of the groove's cross-section. This condition determines the corrective positioning of the wheel, i.e. its tilting.

Figure 4:
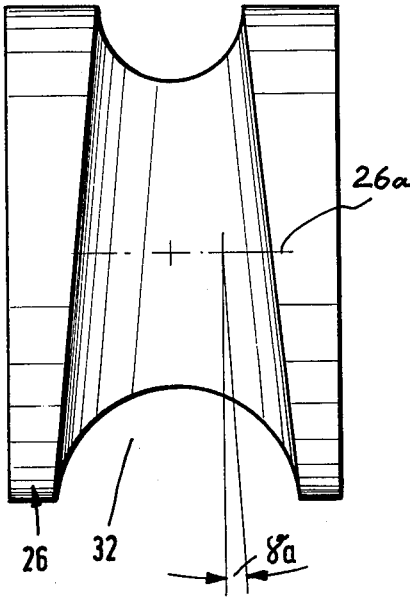
FIGS. 4 and 6 are views of different portions of the periphery of a roll.
Figure 5:
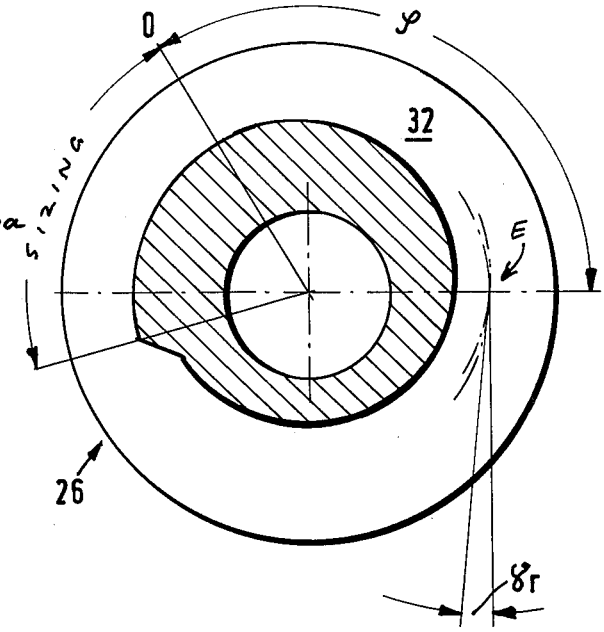
FIG. 5 is a section taken transversely to the axis of the roll and through the bottom of the groove.
Figure 6:
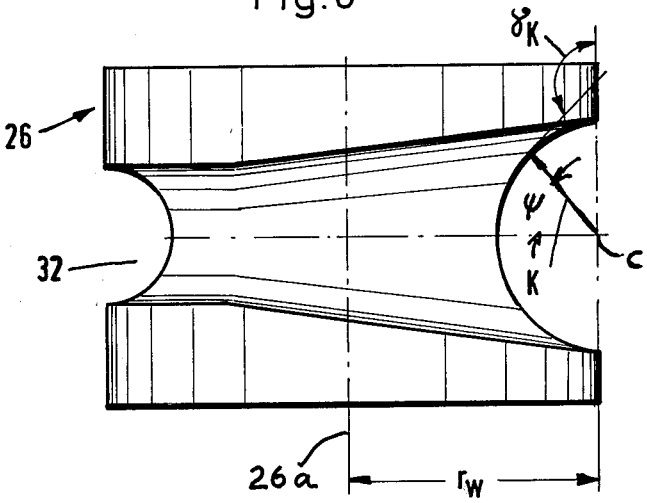
Figure 7:
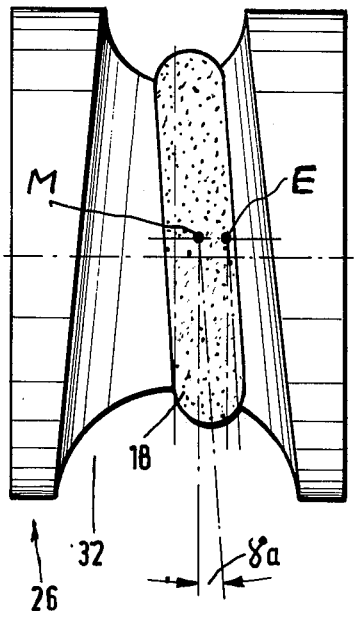
FIGS. 7, 8 and 9 correspond to FIGS. 4, 5 and 6, but show the roll in cooperation with the grinding wheel or disk of the machine shown in FIGS. 1, 2 and 3.

FIGS. 4 to 6 illustrate the various relevant angles for a pilger roll and other relevant contour parameters. The point of engagement between roll and grinder is defined by several geometric components. These components use several basic parameters of the roll as a reference. One reference is, of course, the axis 26*a* of the roll. Another reference is the cylindrical, unmodified outer periphery of the roll having radius rw. A further reference is the center plane for the groove 32, i.e. a plane extending transversely to the axis and through the groove's bottom. The intersection of that plane with the roll's cylinder surface defines a circle c which, as to each radial plane, defines the center of the groove's cross-section in that plane. The components are (1) Angel $\phi$ (phi) between a zero point of the roll and a radial plane through a point E of engagement with the grinding wheel (FIG. 5);

(2) Angle $\phi$ (psi), in that radial plane (e.g. a plane parallel to FIG. 6) and between the axial plane of circle c, and the line drawn from the point c in the radial plane of cross-section through the point E of engagement;

(3) A radius vector k extending from the groove center c to that point of engagement. The groove center c is located at the radius rw from axis 26*a*.

The vector k can also be termed the local radius of the groove in any given radial plane. That vector K would be constant if the groove were semicircular, which it is not. Rather, vector k (i.e. its length value) is actually a function of $\phi$(phi) and $\psi$ (psi) as defined above. In other words, k as a function of $\phi$ and $\psi$ defines the contour of the groove. One could, of course, define that contour also from the center axis of the roll as rw−k. However, the chosen mode of geometric description is more convenient as it more explicitely describes the insertion of the work point of the grinding tool into the groove.

The function k can be written as an equation of three functions f, g and h; $k=f+g\times h$, wherein f is a function of $\phi$ (phi) alone, defining the contour of the groove bottom as it varies azimuthally on the roll. One can also say that f would be the groove radius, were it constant in a radial plane. h is a function of $\psi$ alone and determines the deviation of the groove's cross-section from, e.g. a semicircular contour. g is a function of roll azimuth angle $\phi$ determining how that function h varies along the groove, i.e. in azimuthal direction. Thus, g is also a function of $\phi$ only.

In view of the fact that the groove defining vector k is not constant, several particular angles of inclination have to be defined as they are indicative of slope changes of the groove. As can be seen from FIG. 5, the groove becomes deeper from line O in clockwise direction. This has an effect on the entire groove and is noticable in any point of the groove, not just the bottom. One can speak here of a down-slope by an angle $\gamma_r$ (gamma-r), denoting in any point a directional change of the groove in azimuthal direction amounting to a deviation from a semi-toroidal curve (see FIG. 5). Another slope change in the groove occurs in axial direction, as the groove, e.g., becomes wider. That slope change is measured by a directional change in the groove's contour from a toroidal configuration by an angle $\gamma_a$ (gamma-a).

These angles of inclination (derivative) of the groove in the several points of engagement, and defining the (spatial) rate of change of the groove in azimuthal direction are determined from the three components and functions as follows:

$$\tan \gamma_r = \frac{f'(\phi) + g'(\phi) \times h(\psi) \times \text{Sin } \psi}{\gamma_w - k \times \cos \psi}$$

herein f' and g' are the respective derivatives of the functions f ($\phi$) and g ($\phi$)

$$\tan \gamma_a = \frac{f'(\phi) + g'(\phi) \times h(\psi) \times \cos \psi}{\gamma_w - k_g \times \cos \psi}$$

There is still another relevant angle, $\gamma_k$ (gamma-k). This is the slope of the groove in a radial plane, relative to the cylinder (line) of the unmodified roll periphery in that radial plane. This angle of inclination $\gamma_k$ (FIG. 6) is given by $$\gamma_k + 180° - \psi + \arctan \frac{g(\phi) \times h'(\psi)}{k}$$

In the case of a semicircular groove, $h'=O$ $\gamma_k = 180° - \psi$. Generally, $\gamma$, is the angle between a tangent on the groove in the point of engagement and in the radial plane, and the line through c being orthogonal to the radius $r_w$, which is a line in the above mentioned tangent plane to the unmodified roll.

In the description above, we have introduced rather generally the directions x, y and z, now we shall use them to establish and define specific coordinates. The directions were introduced as directions of motion of various carriages by means of the x, y and z drives. We shall now use that coordinate system to describe geometrically the grinding process.

The grinding process and the position of the tool (wheel 18) relative to the roll is determined by the point of engagement E. That point may vary over the peripheral contour of the disk. Therefore, it is helpful for further analysis to introduce the center M of the profile of the semicircular peripheral contour and the radius $r_a$, of the periphery of the wheel 18. The points or centers M are located on a circle around the wheel's axis. A specific center M is defined as that point having the same radial plane of the disk 18 as the point of engagement E. The various drives of the machine establish that point E.

Figure 8:
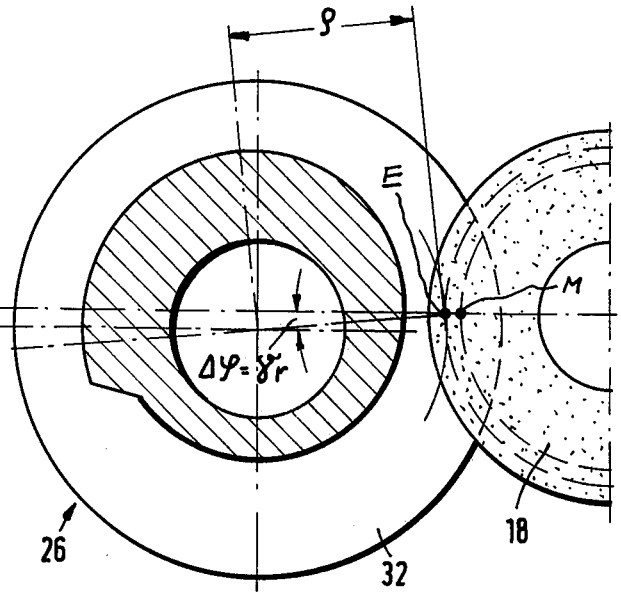
Figure 9:
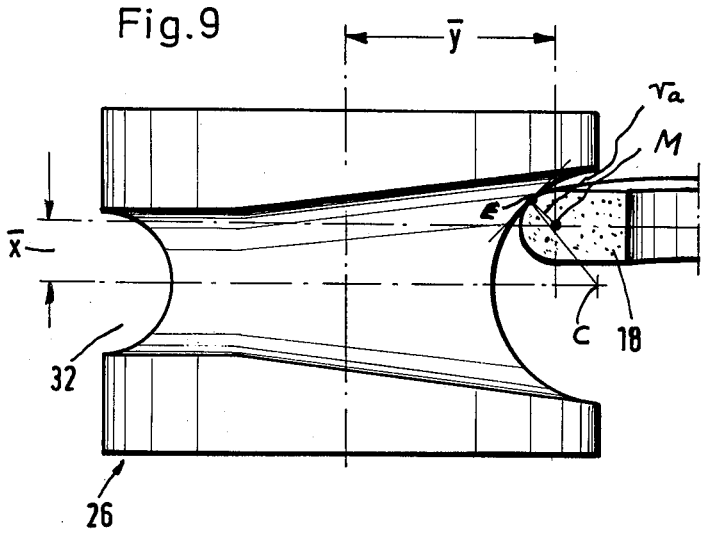

As a first approach one can say that the position drives establish the position of a point M as defined, particularly in relation to the center of the roll as positioned, which roll center, in turn, is defined by the intersection of the roll's axis and of the groove bottom center plane, which is also the plane of circle c. Therefore, we define the following position values $\bar{x}$, $\bar{y}$ and $\bar{z}$; $\bar{x}$ is the distance of point M from the roll center plane defined, e.g. by the plane of the circle of all points c. $\bar{y}$ is the projection of the distance between roll axis and point E onto the y direction, augmented by the projection of the distance of points E and M onto the y direction. $\bar{z}$ is the projection of the distance of point E from the roll axis onto the z axis or direction (FIG. 8). In addition, the following parameter should be defined: $\rho$ (rho) is the distance of the point of engagement E from the center of the roll.

It can thus be seen that $\bar{x}$, $\bar{y}$, $\bar{z}$ are coordinate values for the point M in relation to the center of the roll. Moreover, E and M have always the same $\bar{z}$ value so that $\bar{z}$ can also be defined as the projection of the distance of roll and wheel axes onto the z axis or direction.

The position of M, however, is directly related to the position of the grinding wheel its axis and support structure and the circle defined by the points M has a constant radius. Therefore, these coordinates $\bar{x}$, $\bar{y}$ and $\bar{z}$ define the requisite position adjustment for the wheel 18 and the roll in relation to each other. In addition, wheel 18 is tilted by a certain amount relative to any axial plane through the roll, and by the angle $\gamma_a$ (gamma-a). This tilt can also be understood with point E as a hypothetical fulcrum.

As the grinding process is necessarily determined the the position relation between tool (disk 18) and work (roll 26), $\bar{x}$, $\bar{y}$ and $\bar{z}$ determine, in fact, the grinding process. For reasons of geometry and triangulation, these values are determined as follows:

$$\bar{x} = k \times \sin \psi = (r_a \times \sin t / \cos \gamma_a)$$

$$\bar{y} = (r_w - k \times \cos \psi) \cos \gamma_r + r_a \cos t$$

$$\bar{z} = (r_w - k \times \cos \psi) \sin \gamma_r.$$

One can also say that $\bar{x}$ is the displacement of the grinding disk in direction of the x-axis from the c-plane (established by the position of the work-roll 26). $\bar{y}$ is the requisite advance of the grinding wheel in the y direction, and z is the vertical mutual misalignment of the roll and disk axes. In these equations, and has used the auxiliary parameter $t = \tan \gamma_k \cos \gamma_a$, which is indicative of the requisite tilt correction. As a consequence, the grinding disk 18 is pivoted or tilted in a manner which appears as a pivoting about the point E by the inclination angle $\gamma_a$ (gamma-a); the slide lever 14 has to be shifted by a proportionate amount. The second correction needed is given by an angle $\Delta\phi$, namely a correction for the rotational position of the roll in any instant as stated earlier, drive 27 provides for the rotation of work roll 26 to obtain azimuthal advance; the correction presently described is superimposed by operation of the control, and that correction is, in fact, equal to the inclination angle $\gamma_r$ (gamma-r). In other words, and as can be discerned from FIG. 8, the grinding wheel has been shifted up (z direction) by the distance $\bar{z}$, so that the roll appears to be pivoted about the point of engagement E by that inclination angle gamma-r. The direction of that pivoting of work 26 about the point of contact E (by displacement of the roll and wheel axes relative to each other out of the plane of the axis of the wheel 18 and the work point E) corresponds to a shifting of the work point towards shallower groove portions, which in the drawing of FIG. 8 results in counterclockwise pivoting of the roll 26 relative to point E about angle gamma-r. One can also say that a line drawn through point E and the axis of the roll in an axial plane (parallel to the plane of the drawing of FIG. 8) has an angle $\gamma_r$(=gamma-r) to a radial line from E through the axis of disk or wheel 18, projected into the axial plane of the roll as defined. That angle $\gamma_r$ can be termed the angle of slope change of the groove from a toroidal groove in that point E.

In order to practice the invention and to run the illustrated machine, the controller 33 must be operated to move the several drives so that the work and the tool assume positions in relation to each other in which the point of engagement is defined as per the $\bar{x}$, $\bar{y}$, $\bar{z}$ values above. The controller 33 may include or be loaded from a computing facility which provides a sequence of sets of position signals, each set moves the tool into a particular position and the sequence determines the sequence of grinding. The primary input parameters for the computing facility are the functions f ($\phi$), g ($\phi$) and h ($\psi$), as they determine the radius k=k ($\phi$,$\psi$), dfining the groove geometrically. From the equations above one can see that the computer calculates at first $\gamma_r$ and $\gamma_a$ as functions of $\psi$ and $\phi$ as well as the auxiliary parameters $\gamma_k$ and t. $r_w$, $r_a$ are work and machine parameters and from these values one can calculate as many $\bar{x}$, $\bar{y}$ and $\bar{z}$ data as one may wish to establish different grinding positions. Actual machine tool position data requires merely the $\bar{x}$, $\bar{y}$ and $\bar{z}$ data determining the point M to be translated into data for positioning the disk 18, which is the result of fixed parameter transformation on the basis of the circle M to arrive at the position data for the several drives, including the tilt drive. In order to actually grind, a rule of procedure is established, e.g. as follows. The roll is hypothetically divided into n radial sections, e.g. n=43. The sizing portion of the roll groove (k not variable with $\phi$) may be divided into two sections, one in which k is also constant with $\psi$ (semicircular groove) and one which is not (h$\neq$0), i.e. the groove widens, but does not deepen. The remaining section, e.g. k3, each are associated with a set of parameters $\phi$, f, f', g, g', h; corresponding to deepening and widening of the groove. In addition, one choses the step $\Delta\psi$, which is the incremental angle by which adjacent points of grinding are apart in the same radial plane, $\Delta\psi$, in effect, is from position to position a (different) set of $\Delta x$ and $\Delta y$ values by means of which the tool must be shifted in the x and y directions. Further parameters are system and work oriented such as the effective grinding speed etc. This parameter as well as the work feed rate, the step $\Delta\psi$ and the chosen grinding wheel, radius $r_a$ of the work toroid, depend on the conditions of grinding, including scouring and finishing.

Grinding may start for $\psi$=0, i.e. at the bottom of the groove and the computer calculates the $\bar{x}$, $\bar{y}$ and $\bar{z}$ values for $\psi$=90° and in accordance with the chosen azimuthal grinding stops and steps. The roll is rotated during grinding, and the controller 33 updates the relevant position data as needed and commensurate with $\phi$— sectors above.

For the next revolution of the roll, the computer calculates the parameters and position data on the basis $\psi$=90°−$\Delta\psi$. For the next revolution the input is $\psi$=90°−2$\Delta\psi$ etc. Please not that for $\psi$=0, $\bar{x}$=0, and there is no tilt of the disk, but there is a pivot $\Delta\phi$, i.e. $\bar{z}\neq$0. For $\psi$=90° the groove has been ground completely.

Any speed error on account of systems lag can be corrected by the controller for each of the coordinate values. This is true because a system inherent speed error (if detected and hypothetically corrected by feedback) is inversely proportional to the amplification gain of the correction imparted upon the drive for the roll, but proportional to the speed itself. That ratio is a fixed parameter and can be used for correction of the x, y and z parameters by the controller.

The invention is not limited to the embodiments described above but all changes and modifications thereof not constituting departures from the spirit and scope of the invention are intended to be included.

We claim:

1. Apparatus for grinding the groove in a roll for pilger rolling, including a machine stand;

first means for supporting the roll on the stand and including means for rotating such a roll about a first axis; a grinding wheel;

second means for supporting the grinding wheel on the the stand, the grinding wheel rotating about a second axis;

means for moving the second and first means in relation to each other and in relation to three perpendicular coordinate axes, a first one of which is parallel to the first axis, and the two others are at right angles to the first axis, whereby a second one of the coordinate axis runs in a direction commensurate to movement of the second axis towards or away from the first axis as defined by the first means, and a third one of the three coordinate axes is perpendicular to the first and second coordinate axes, to position the wheel relative to the groove, to thereby establish a particular work point, in which the wheel engages the groove of the roll as supported by the first means;

first control means for causing the means for moving to move the first and second means in relation to each other in directions of the first and second coordinate axes;

second control means for the means for moving, operatively connected to the means for moving and to the means for rotating, to respectively shift the first and second means in a direction of the third coordinate axis and to correctively rotate the roll as supported, for positioning the roll as supported by the first means and the wheel in relation to each other so that the roll as supported by the first means has a position in which its axis is pivoted out of a plane through the axis of the wheel and the work point; and means for tilting the grinding wheel about an axis parallel to the second coordinate axis out of a position of parallelism of its axis with the axis of the roll as supported by the first means.

2. Apparatus as in claim 1, the first means including a carriage movable in the direction along the third coordinate axis, a work spindle on the carriage connected to and driven by the means for rotating, and means for mounting the roll on the work spindle, the means for moving including a drive on the stand drivingly coupled to the carriage for moving the carriage in said direction along said third axis.

3. Apparatus as in claim 1 or 2, said second means including a slide carriage mounted on the stand for moving in a direction, corresponding to one of said first and second coordinate directions, further including a second carriage on the carriage moving in a direction corresponding to the other one of the first and second coordinate directions, the means for tilting being mounted on the second carriage, the second means further including a grinding wheel holder on the second carriage.

4. Apparatus for grinding the groove in a roll for a pilger roll, including a machine stand, further including means for rotatably supporting such a roll and means for rotating the roll about a first axis, further including a grinding wheel and a support and drive for rotating the grinding wheel, further including means for moving the grinding wheel and roll support means relative to each other in a particular direction towards and away from the first axis, the improvement comprising:

the grinding wheel having an axis of rotation normally parallel to the first axis, and means for tilting the grinding wheel about an axis parallel to said particular direction, to assume positions in which the grinding wheel axis does not run parallel to said first axis.

5. Apparatus as in claim 4 and including first control means for shifting the roll support means and the grinding wheel in a direction perpendicular to both, said particular direction and said first axis, and second control means for compensatorily causing the roll rotating means to rotate the roll about the first axis, independantly from the rotational advance of the roll for azimuthal progression of the grinding.

6. Apparatus as in claim 4, and including control means to position the grinding wheel in relation to the roll support means to obtain a point of the wheel for engagement with the roll so that a plane running through that point and including the axis of the grinding wheel does not run through the first axis, independantly from the tilted position.

* * * * *